US011170655B2

(12) United States Patent
Schwartz et al.

(10) Patent No.: US 11,170,655 B2
(45) **Date of Patent: *Nov. 9, 2021**

(54) AIRCRAFT ARRIVAL DETERMINATION SYSTEMS AND METHODS

(71) Applicant: THE BOEING COMPANY, Chicago, IL (US)

(72) Inventors: Samantha A. Schwartz, Castle Pines, CO (US); Garoe Gonzalez Parra, Frankfurt am Main (DE); Adam Karwan, Gliwice (PL); Marcin Zadroga, Gdynia (PL); Daniel Roman Jaroszewski, Wiebaden (DE); Wolfgang Ludwg Mergenthaler, Floersheim am Main (DE)

(73) Assignee: THE BOEING COMPANY, Chicago, IL (US)

( * ) Notice: Subject to any disclaimer, the term of this patent is extended or adjusted under 35 U.S.C. 154(b) by 36 days.

This patent is subject to a terminal disclaimer.

(21) Appl. No.: 16/796,279

(22) Filed: Feb. 20, 2020

(65) Prior Publication Data

US 2020/0193845 A1 Jun. 18, 2020

Related U.S. Application Data

(63) Continuation of application No. 15/682,617, filed on Aug. 22, 2017, now Pat. No. 10,607,493.

(51) Int. Cl.
*G08G 5/00* (2006.01)

(52) U.S. Cl.
CPC ..... *G08G 5/0039* (2013.01); *G08G 5/0008* (2013.01); *G08G 5/0013* (2013.01); *G08G 5/0021* (2013.01); *G08G 5/0026* (2013.01); *G08G 5/0034* (2013.01); *G08G 5/0043* (2013.01); *G08G 5/0056* (2013.01); *G08G 5/0078* (2013.01); *G08G 5/0082* (2013.01); *G08G 5/0091* (2013.01)

(58) Field of Classification Search
CPC .. G08G 5/0039; G08G 5/0043; G08G 5/0021; G08G 5/0056; G08G 5/0095; G08G 5/025; G01C 23/005; G01C 23/00; G05D 1/0676; B64D 43/00
See application file for complete search history.

(56) References Cited

U.S. PATENT DOCUMENTS 8,565,944 B1 * 10/2013 Gershzohn ..... G08G 5/025 701/14
2011/0087388 A1 * 4/2011 Watson ..... G01C 23/00 701/16

* cited by examiner

*Primary Examiner* — Ryan Rink
(74) *Attorney, Agent, or Firm* — The Small Patent Law Group LLC; Joseph M. Butscher

(57) ABSTRACT

An aircraft arrival determination system includes an arrival sequence determination unit that is configured to determine a position of an aircraft within a landing queue for a destination airport and an estimated landing time for the aircraft at the destination airport. A landing suggestion unit is configured to provide a landing suggestion for the aircraft. The landing suggestion provides information related to landing at the destination airport or diverting from the destination airport to an alternate airport.

20 Claims, 5 Drawing Sheets

AIRCRAFT ARRIVAL DETERMINATION SYSTEMS AND METHODS

RELATED APPLICATIONS

This application is a continuation of U.S. patent application Ser. No. 15/682,617, entitled "Aircraft Arrival Determination Systems and Methods," filed Aug. 22, 2017, now U.S. Pat. No. 10,607,493 which is hereby incorporated by reference in its entirety.

FIELD OF THE DISCLOSURE

Embodiments of the present disclosure generally relate to systems and methods for dynamically determining (for example, generating, calculating, adapting, and/or the like) aircraft arrivals at one or more airports, and, more particularly, to systems and methods for determining whether or not aircraft are to be rerouted to alternate airports.

BACKGROUND OF THE DISCLOSURE

Commercial aircraft are used to transport passengers between various locations. A commercial aircraft generally flies according to a predetermined flight plan between a departure airport and a destination airport. The flight plan includes a path from the departure airport to the destination airport, and may also include a flight time between the locations.

For various reasons, commercial, business, and general aviation aircraft may be diverted from a flight plan. For example, inclement weather may cause an air traffic controller to divert an aircraft from a flight plan. Due to inclement weather (such as rain or snow), visibility at a destination airport may be limited. Accordingly, an air traffic controller may then determine that separation times between landing aircraft need to be increased. As another example, flight congestion at a destination airport may also cause the air traffic controller to divert an aircraft from a flight plan into a holding pattern. An aircraft may be diverted into a holding pattern, which deviates from the flight plan, in order to accommodate landing delays at a particular destination airport, whether due to inclement weather, flight congestion, and/or the like.

Various airports are extremely busy, such that a relatively high number of aircraft are scheduled to land at various times during a typical day. An air traffic controller communicates with a pilot of a particular aircraft to provide landing information. The pilot may discover that the scheduled arrival time has been delayed, at which point the pilot needs to determine if the aircraft has sufficient fuel to safely land at the updated, later landing time, or if the aircraft should be diverted to an alternate airport. As can be appreciated, additional delays may occur, which may further set back a time of arrival for a particular aircraft.

SUMMARY OF THE DISCLOSURE

A need exists for a system and method for accurately predicting a time of arrival of an aircraft at a destination airport. Further, a need exists for a system and method for allowing a pilot to quickly and accurately assess a need to divert a flight to an alternate airport due to an expected delay at an original destination airport.

With those needs in mind, certain embodiments of the present disclosure provide an aircraft arrival determination system that includes an arrival sequence determination unit that is configured to determine a position of an aircraft within a landing queue for a destination airport and an estimated landing time for the aircraft at the destination airport. A landing suggestion unit is configured to provide a landing suggestion for the aircraft. The landing suggestion unit provides information related to landing at the destination airport or diverting from the destination airport to an alternate airport. In at least one embodiment, the landing suggestion unit is configured to provide the landing suggestion based on a first distance between the aircraft and the destination airport, a second distance between the aircraft and the alternate airport, and a remaining amount of fuel of the aircraft.

The aircraft arrival determination system may include a tracking sub-system that is configured to track a location of the aircraft in relation to the destination airport. The tracking sub-system may be an automatic depending surveillance-broadcast (ADS-B) tracking sub-system.

The aircraft arrival determination system may include a weather detection sub-system that is configured to detect weather conditions proximate to the destination airport.

In at least one embodiment, the aircraft arrival determination system includes a user interface that is configured to show the position of the aircraft within the landing queue for the destination airport and the estimated landing time for the aircraft at the destination airport. The user interface is configured to provide a clear and concise visual display that allows an individual to quickly and easily determine whether there is a need to divert from the destination airport to an alternate airport. In at least one embodiment, the user interface is onboard the aircraft.

The user interface may include one or more of a weather section that is configured to show weather graphics indicative of current weather conditions at one or both of the destination airport or the alternate airport, a traffic section that is configured to show traffic graphics indicative of a current position of the aircraft within the landing queue for the destination airport, a fuel factors section that is configured to show a bug out fuel graphic indicative of an amount of fuel left for the aircraft to land at the alternate airport, and/or one or both of an airport comparison section or a comparison graph that are configured to show a graphical representation of a landing decision comparison between the destination airport and the alternate airport.

Certain embodiments of the present disclosure provide an aircraft arrival determination method that includes determining, by an arrival sequence determination unit, a position of an aircraft within a landing queue for a destination airport and an estimated landing time for the aircraft at the destination airport. In at least one embodiment, the method also includes providing, by a landing suggestion unit, a landing suggestion for the aircraft. The landing suggestion provides information related to landing at the destination airport or diverting from the destination airport to an alternate airport.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide aircraft arrival determination systems and methods that are configured to support pilots, dispatchers, and the like with respect to flights that may need to be diverted to an alternate airport. The systems and methods are configured to continuously analyze an air traffic situation at an original destination airport, such as by monitoring a number of aircraft in a landing queue, including aircraft that are in holding patterns. The systems and methods also monitor weather, airport capacity, and/or other relevant information (such as emergency landing requirements). The systems and methods monitor air traffic in relation to an airport, and estimate an estimated time of arrival for aircraft.

Embodiments of the present disclosure are used to effectively determine arrival times at airports, particularly those at which a high number of aircraft are scheduled to land. The systems and methods determine estimated landing times for the aircraft, and provide diversion suggestions for aircraft that may be running low on fuel.

Certain embodiments of the present disclosure provide a system that is configured to analyze arrival air traffic and re-route and re-assign arrival sequences to improve airport efficiency. The system identifies and routes aircraft to alternate airports to avoid emergency situations (such as when an aircraft runs low on fuel). In at least one embodiment, the system provides a graphical display to pilots, dispatchers, or the like improving situational awareness of air traffic in an airspace. In at least one embodiment, the graphical display includes a visual control panel that shows information about key arrival parameters that are used to evaluate traffic flows at airports and alternate airports, optimizing arrival flows and diversions to alternate airports.

Figure 1:
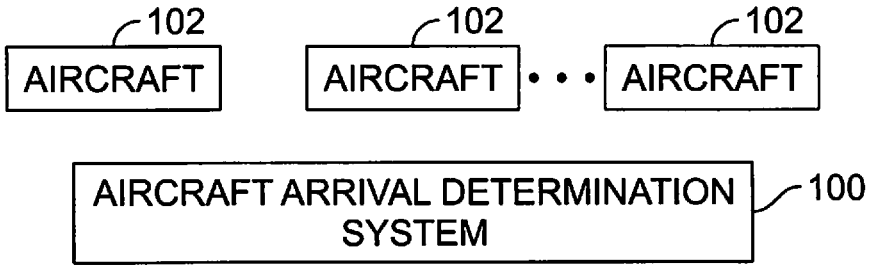
FIG. 1 is a simplified box diagram of an aircraft arrival determination system in communication with a plurality of aircraft, according to an exemplary embodiment of the present disclosure.

FIG. 1 is a simplified box diagram of an aircraft arrival determination system 100 in communication with a plurality of aircraft 102, according to an exemplary embodiment of the present disclosure. The aircraft 102 are scheduled to arrive (that is, land) at a destination airport. The aircraft arrival determination system 100 is in communication with each of the aircraft 102 (such as through one or more communication devices, such as antennas, transceivers, and/or the like). The aircraft arrival determination system 100 monitors the locations of the aircraft 102 relative to the destination airport, and determines a position (for example, ordered position) of each aircraft 102 within a landing queue in relation to the destination airport. Pilots of the aircraft 102, air traffic controllers, and/or dispatchers may monitor a position in a landing queue, and an estimated time of arrival in conjunction with various parameters (including remaining fuel and weather conditions) to assess whether or not to divert the aircraft 102 to an alternate airport for landing.

The aircraft arrival determination system 100 may be located at the destination airport, or at the alternate airport. In at least one other embodiment, the aircraft arrival determination system 100 may be located at a central monitoring location that is remotely located from the destination airport and the alternate airport. In at least one other embodiment, the aircraft arrival determination system 100 may be onboard an aircraft, such as any of the aircraft 102 shown in FIG. 1.

The aircraft arrival determination system 100 may be in communication with more or less aircraft 102 than shown in FIG. 1. For example, the aircraft arrival determination system 100 may be in communication with fifty, one hundred, or more aircraft 102 that are scheduled to land at a destination airport.

Figure 2:
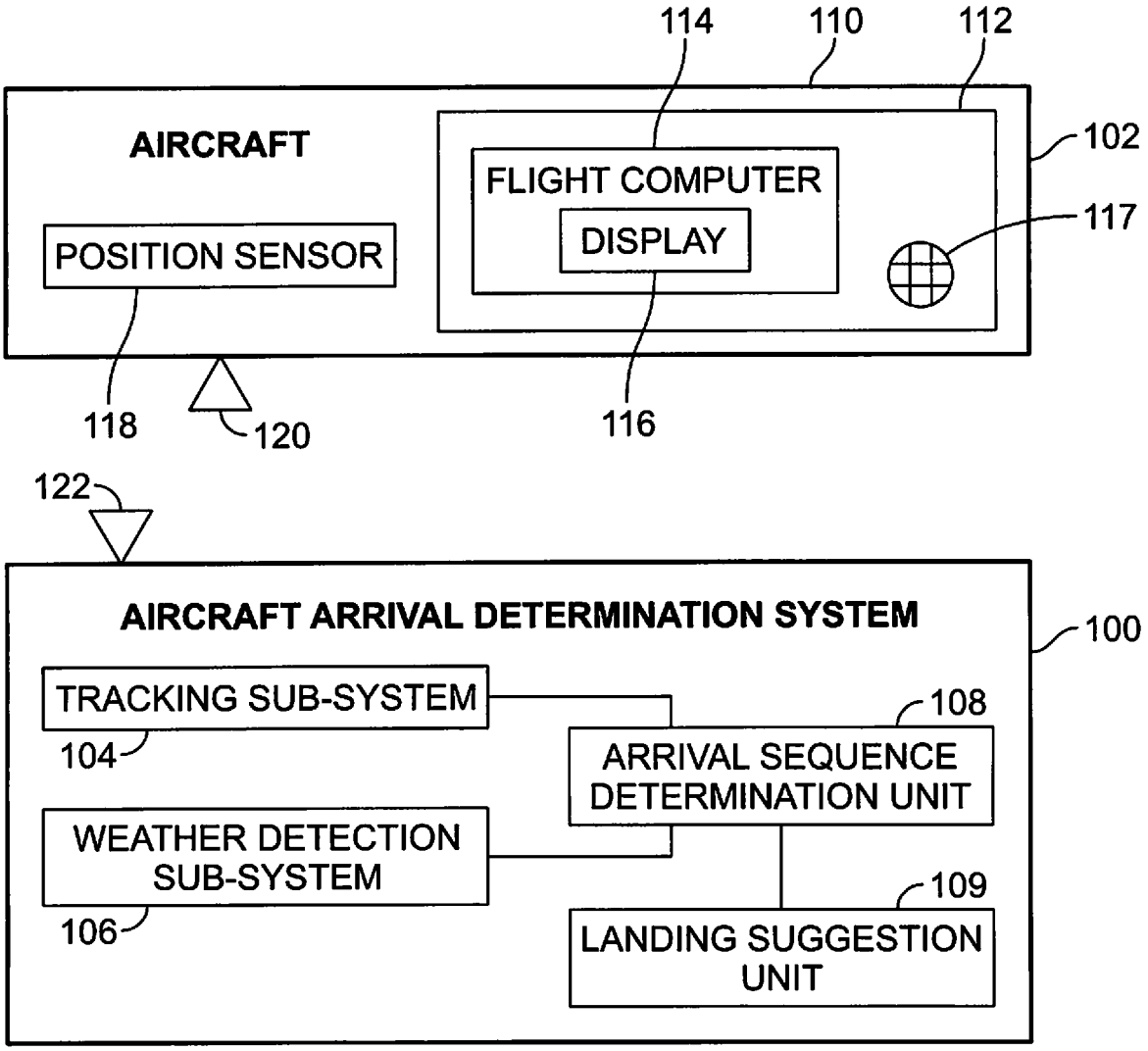
FIG. 2 is a schematic representation of an aircraft arrival determination system in communication with an aircraft, according to an exemplary embodiment of the present disclosure.

FIG. 2 is a schematic representation of the aircraft arrival determination system 100 in communication with an aircraft 102, according to an exemplary embodiment of the present disclosure. For the sake of clarity, only one aircraft 102 is shown in FIG. 2. However, it is to be understood that the aircraft arrival determination system 100 may be in communication with any number of aircraft 102 that are scheduled to land at a particular destination airport. A pilot of a particular aircraft 102 may have no control over a position of the aircraft 102 in relation to a landing queue. Instead, each aircraft 102 may be individual prioritized by air traffic control.

In at least one embodiment, the aircraft arrival determination system 100 includes a tracking sub-system 104 that is configured to track a current position of the aircraft 102 proximate to (such as within 150 miles of) a destination airport. In at least one embodiment, the aircraft arrival determination system 100 also includes a weather detection sub-system 106 that is configured to detect current weather conditions at and proximate to (such as within 150 miles or less of) the destination airport.

The aircraft arrival determination system 100 includes an arrival sequence determination unit 108 that is in communication with the tracking sub-system 104, such as through one or more wired or wireless connections. For example, the arrival sequence determination unit 108 may wirelessly communicate with the tracking sub-system 104 through one or more transceivers, radio units, and/or the like.

The arrival sequence determination unit 108 is also in communication with the weather detection sub-system 106, such as through one or more wired or wireless connections. The weather detection sub-system 106 communicates the current weather at and proximate to one or more airports to the arrival sequence determination unit 108. For example, the weather detection sub-system 106 may be a meteorological and weather service that is in communication with the arrival sequence determination unit 108. In at least one other embodiment, the weather detection sub-system 106 may be an independent weather determination and forecasting system and/or service. For example, the weather detection sub-system 106 may include one or more Doppler radar installations.

The aircraft arrival determination system 100 also includes a landing suggestion unit 109 that is in communication with the arrival sequence determination unit 108, such as through one or more wired or wireless connections. The landing suggestion unit 109 may also be in communication with the tracking sub-system 104 and/or the weather detection sub-system 106, such as through one or more wired or wireless connections. The landing suggestion unit 109 is configured to output a landing suggestion signal indicative of a landing suggestion to the aircraft 102. The landing suggestion provides an indication of whether the aircraft 102 should land at the destination airport, or divert to an alternate airport, based on a remaining amount of fuel of the aircraft 102, a distance between the aircraft 102 and the destination airport, and/or a distance between the aircraft 102 and the alternate airport.

The landing suggestion unit 109 and the arrival sequence determination unit 108 may be separate and distinct processing units. Optionally, the landing suggestion unit 109 and the arrival sequence determination unit 108 may be part of a unitary processing unit. Alternatively, the aircraft arrival determination system 100 may not include the landing suggestion unit 109.

In at least one embodiment, the tracking sub-system 104, the weather detection sub-system 106, the arrival sequence determination unit 108, and the landing suggestion unit 109 may be located at a particular location, such as a destination airport. Optionally, the tracking sub-system 104 and/or the weather detection sub-system 106 may be remotely located from the arrival sequence determination unit 108 and/or the landing suggestion unit 109. In at least one embodiment, the tracking sub-system 104, the weather detection sub-system 106, the arrival sequence determination unit 108, and the landing suggestion unit 109 may be part of a single, common computing system at a common location.

The aircraft 102 includes a main body or fuselage 110 that defines an internal cabin 112, which includes a cockpit and may also include a passenger seating area. A flight computer 114 within the internal cabin 112 includes or is otherwise coupled to a display 116, such as monitor, touchscreen, and/or the like, and/or a speaker 117.

The aircraft 102 may also include a position sensor 118, such as a global positioning system sensor, an automatic depending surveillance-broadcast (ADS-B) sensor, and/or the like. The position sensor 118 outputs a signal indicative of one or more of the position, altitude, heading, acceleration, velocity, and/or the like of the aircraft 102. Alternatively, the aircraft 102 may not include the position sensor 118 (and the position of the aircraft 102 may be monitored through radar, for example). The aircraft 102 may also include a communication device 120, such as a transceiver, radio unit, and/or the like, that allows the aircraft 102 to wirelessly communicate with a similar communication device 122 of the aircraft arrival determination system 100.

The tracking sub-system 104 is configured to track a current position of the aircraft 102. In at least one embodiment, the tracking sub-system 104 is an ADS-B tracking sub-system. In such an embodiment, the ADS-B tracking sub-system 104 determines a current position of the aircraft 102 via satellite navigation through a positional signal of the aircraft 102 that is output by the position sensor 118. The position sensor 118 may be or include a transmitter that periodically outputs information about the aircraft 102, such as identification details, current position, current altitude, and current velocity. The tracking sub-system 104 receives the transmitted position signal from the position sensor 118 to determine a current and real time position, heading, velocity, and the like of the aircraft 102. Alternatively, the tracking sub-system 104 may be a radar system or other such system that is configured to track the position of the aircraft.

As shown, the aircraft arrival determination system 100 may be separate and distinct from the aircraft 102. For example, the aircraft arrival determination system 100 may be located at a land-based monitoring center. In at least one other embodiment, the aircraft arrival determination system 100 may be onboard the aircraft 102, another aircraft, watercraft, spacecraft (for example, a satellite), and/or the like.

Referring to FIGS. 1 and 2, in operation, the tracking sub-system 104 tracks the current positions of the various aircraft 102 scheduled to land at a destination airport, such as through ADS-B signals and/or information. The arrival sequence determination unit 108 analyzes the tracked positions of the aircraft 102 to determine a position (for example, an ordered position) in a landing queue for each aircraft 102 in relation to the destination airport. In at least one embodiment, the arrival sequence determination unit 108 orders each aircraft 102 in the landing queue based on a time each aircraft arrives within a particular distance from the destination airport. For example, if a first aircraft 102 arrives at a predetermined distance (such as within 150 miles) from the destination airport at a first time, the first aircraft 102 is positioned (for example, ordered, ranked, slotted, or the like) in the landing queue before a second aircraft 102 that arrives at the predetermined distance from the destination airport at a second time, which is later than the first time. In this manner, the arrival sequence determination unit 108 may position the aircraft 102 in the landing queue for the destination airport in a first in, first out (FIFO) manner. Optionally, the arrival sequence determination unit 108 may allow certain aircraft 102 to move ahead of other aircraft in the landing queue for various reasons, such as based on originally-scheduled landing times, emergency conditions (such as a particular aircraft 102 running low on fuel), priority considerations (for example, certain aircraft operators, passengers onboard certain aircraft, and/or the like may have priority privileges), and/or the like.

The arrival sequence determination unit 108 also receives weather data output by the weather detection sub-system 106. Based on the tracked positions of the aircraft 102 (as detected by the tracking sub-system 104), and the weather conditions at the destination airport (as output by the weather detection sub-system 106), the arrival sequence determination unit 108 determines landing information for the aircraft 102 in relation to the destination airport. The landing information includes a position in a landing queue for the aircraft 102 in relation to the destination airport, as well as an estimated time of arrival at the destination airport. The arrival sequence determination unit 108 transmits the landing information to the aircraft 102, which is then shown on the display 116 and/or broadcast via the speaker 117. A pilot is able to review the landing information as shown on the display 116 and/or broadcast via the speaker 117 to determine whether the aircraft 102 should remain in the assigned position in the landing queue for the destination airport, or divert to an alternate airport, based on certain parameters, such as remaining fuel, for example. In this manner, the aircraft arrival determination system 100 continually monitors locations of the aircraft 102 in relation to the destination airport, determines positions in a landing queue for the aircraft 102, estimates a landing time for the aircraft 102, and allows aircraft personnel (such as pilots) to determine whether or not the aircraft 102 should be diverted to an alternate airport.

The aircraft arrival determination system 100 continually monitors and updates the landing information. In at least one embodiment, the arrival sequence determination unit 108 monitors and continually updates the landing information for each aircraft 102 in real time until the various aircraft 102 land at the destination airport, or are diverted to an alternate airport. The landing information may be adapted and updated, such as if one or more aircraft 102 are moved in front of other aircraft in the landing queue, and/or due to changing weather conditions at the destination airport (such as inclement weather that causes landing delays), for example.

In at least one embodiment, the landing information may be shown on a display and/or broadcast via a speaker at another location (such as at the aircraft arrival determination system 100, a monitoring center, an air traffic control tower at an airport, and/or the like). An individual at the location may then contact a pilot of the aircraft 102 to communicate the landing information.

The landing suggestion unit 109 receives the landing information from the arrival sequence determination unit 108 and determines a landing suggestion for the aircraft 102 based on the amount of fuel remaining in the aircraft, and the landing information. For example, based on the position of the aircraft 102 in the landing queue for the destination airport, the estimated time of landing, and the remaining fuel within the aircraft 102, the landing suggestion unit 109 determines a landing suggestion indicative of whether the aircraft 102 should continue to wait to land at the destination airport, or divert to an alternate airport. The landing suggestion unit 109 outputs a landing suggestion signal indicative of the landing suggestion to the aircraft 102. The landing suggestion may then be shown on the display 116 and/or broadcast via the speaker 117.

The landing suggestion unit 109 may determine a landing suggestion by first determining a distance traveled and/or a time traveled by the aircraft 102. The distance and/or time traveled by the aircraft 102 may be output as a distance signal and/or time signal that is output by the aircraft 102 to the aircraft arrival determination system 100, and analyzed by the landing suggestion unit 109.

The aircraft 102 may also output a fuel-used signal to the aircraft arrival determination system 100 that is indicative of the amount of fuel used by the aircraft 102 during the current flight. The landing suggestion unit receives the fuel-used signal. Based on the amount of fuel used, the amount of fuel remaining in the aircraft may also be determined. In at least one embodiment, the aircraft 102 may output a remaining fuel signal indicative of the amount of fuel remaining for the aircraft 102 to the aircraft arrival determination system 100.

The landing suggestion unit 109 may then determine a distance of the aircraft 102 to the destination airport, such as via a tracked position of the aircraft 102, as detected by the tracking sub-system 104. The landing suggestion unit 109 may then determine a flight time for the aircraft 102 to the destination airport, and the landing information for the aircraft 102, as determined by the arrival sequence determination unit 108. The landing suggestion unit 109 then analyzes both the landing information and the flight time to determine a total travel time to the destination airport for the aircraft 102.

Next, the landing suggestion unit 109 may then determine an expected amount of fuel for the aircraft 102 at a projected time of landing at the destination airport, based on monitored fuel signals output by the aircraft, and the landing information as determined by the arrival sequence determination unit 108.

The landing suggestion unit 109 also determines a distance of the aircraft 102 to the alternate airport, as well as the amount of fuel necessary for the aircraft 102 to fly and land at the alternate airport (that is, the amount of "bug out" fuel). Based on a projected amount of fuel for the aircraft at an estimated time of landing at the destination airport, as well as that for the alternate airport, the landing suggestion unit 109 determines whether the aircraft 102 should land at the destination airport or the alternate airport. For example, if the landing suggestion unit 109 determines that the projected amount of fuel at the destination airport upon landing is within a predetermined safe amount (for example, a fuel tank that is 25% or more full), the landing suggestion unit 109 outputs a landing suggestion to the aircraft 102 indicating that the aircraft 102 is able to safely land at the destination airport. If, however, the landing suggestion unit 109 determines that the projected amount of fuel at the destination airport is below the predetermined safe amount (and that the aircraft 102 has sufficient fuel to land at the alternate airport), the landing suggestion unit 109 outputs a landing suggestion to the aircraft indicating that the aircraft 102 should divert to the alternate airport.

As used herein, the term "control unit," "central processing unit," "unit," "CPU," "computer," or the like may include any processor-based or microprocessor-based system including systems using microcontrollers, reduced instruction set computers (RISC), application specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms. For example, the arrival sequence determination unit 108 and the landing suggestion unit 109 may be or include one or more processors that are configured to control operation of the aircraft arrival determination system 100, as described above. As indicated, the arrival sequence determination unit 108 and the landing suggestion unit 109 may be separate and distinct control units, or may be part of the same control unit.

The arrival sequence determination unit 108 and the landing suggestion unit 109 are configured to execute a set of instructions that are stored in one or more data storage units or elements (such as one or more memories), in order to process data. For example, the arrival sequence determination unit 108 and the landing suggestion unit 109 may include or be coupled to one or more memories. The data storage units may also store data or other information as desired or needed. The data storage units may be in the form of an information source or a physical memory element within a processing machine.

The set of instructions may include various commands that instruct the arrival sequence determination unit 108 and the landing suggestion unit 109 as processing machines to perform specific operations such as the methods and processes of the various embodiments of the subject matter described herein. The set of instructions may be in the form of a software program. The software may be in various forms such as system software or application software. Further, the software may be in the form of a collection of separate programs, a program subset within a larger program or a portion of a program. The software may also include modular programming in the form of object-oriented programming. The processing of input data by the processing machine may be in response to user commands, or in response to results of previous processing, or in response to a request made by another processing machine.

The diagrams of embodiments herein may illustrate one or more control or processing units, such as arrival sequence determination unit 108 and the landing suggestion unit 109. It is to be understood that the processing or control units may represent circuits, circuitry, or portions thereof that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the arrival sequence determination unit 108 and the landing suggestion unit 109 may represent processing circuitry such as one or more of a field programmable gate array (FPGA), application specific integrated circuit (ASIC), microprocessor(s), and/or the like. The circuits in various embodiments may be configured to execute one or more algorithms to perform functions described herein. The one or more algorithms may include aspects of embodiments disclosed herein, whether or not expressly identified in a flowchart or a method.

As used herein, the terms "software" and "firmware" are interchangeable, and include any computer program stored in a data storage unit (for example, one or more memories) for execution by a computer, including RAM memory, ROM memory, EPROM memory, EEPROM memory, and non-volatile RAM (NVRAM) memory. The above data storage unit types are exemplary only, and are thus not limiting as to the types of memory usable for storage of a computer program.

Figure 3:
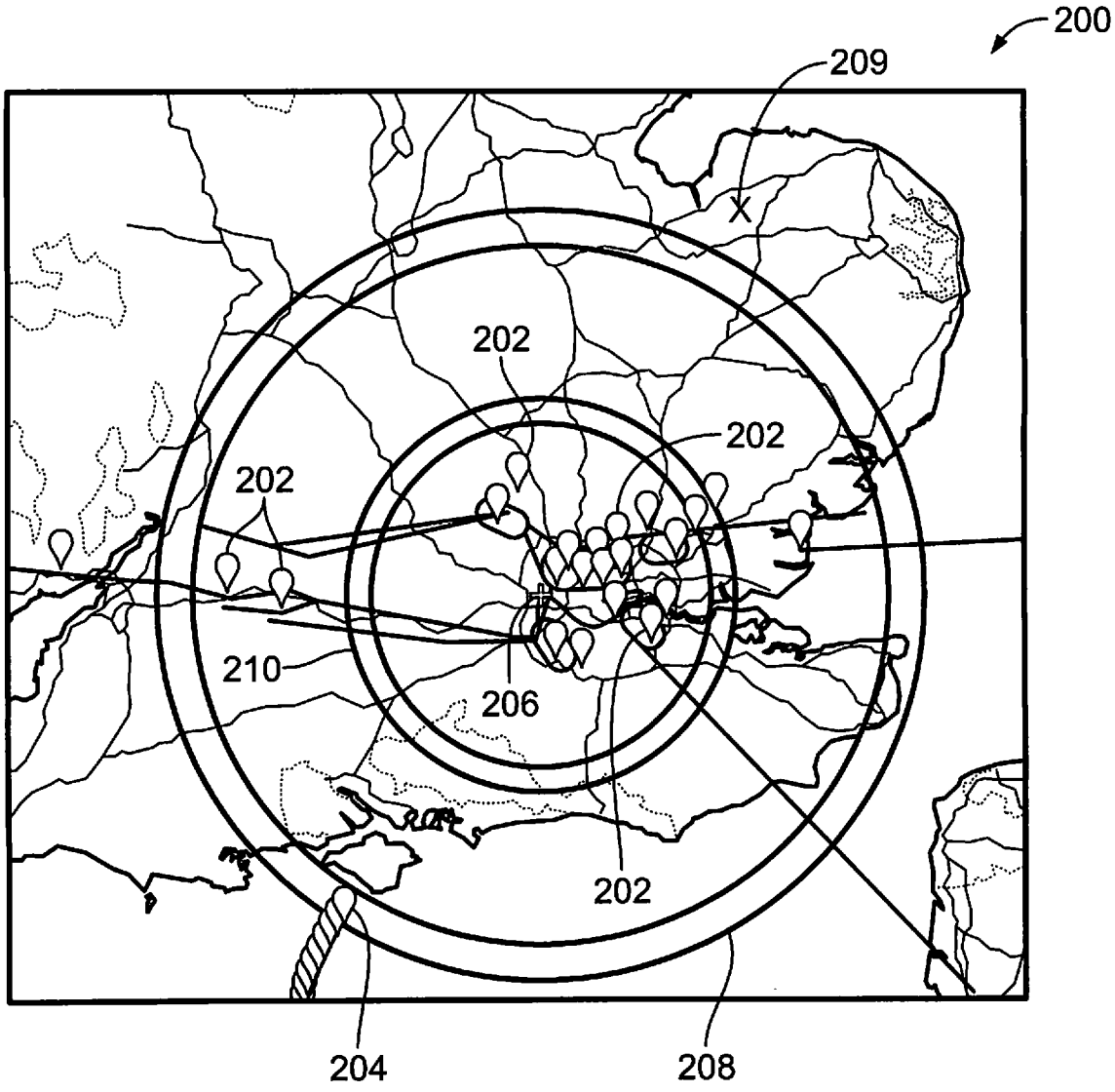
FIG. 3 is a diagrammatic representation of a front view of a display showing indicia of a plurality of aircraft proximate to a destination airport and an alternate airport, according to an exemplary embodiment of the present disclosure.

FIG. 3 is a diagrammatic representation of a front view of a display 200 showing indicia of a plurality of aircraft 202 and 204 proximate to a destination airport 206 and an alternate airport 209, according to an exemplary embodiment of the present disclosure. The aircraft 202 and 204 are shown as indicia on the display 200. The aircraft 204 is approaching an outer radial distance 208 to the destination airport 206. The outer radial distance 208 is indicative of a current distance between the aircraft 204 and the destination airport 206. That is, the outer radial distance 208 represents a current distance between the aircraft 202 and 204 and the destination airport 206. An inner radial distance 210 to the destination airport 206 is indicative of a bug out distance. That is, the inner radial distance 210 represents a decision threshold in which a decision to the alternate airport 206 is to be made before reaching. The aircraft 204 may be safely diverted to the alternate airport 209 when the aircraft 204 is outside of the inner radial distance 210. However, a decision to bug out to the alternate airport may not be made when the aircraft 204 is within the inner radial distance 210.

Referring to FIGS. 1-3, the tracking sub-system 104 tracks the positions of the aircraft 102 (as indicated by 202 and 204, as shown in FIG. 3) that are scheduled to land at the destination airport 206. The arrival sequence determination unit 108 determines landing information for each of the aircraft 102, based on the tracked positions of the aircraft 102, and weather data as output by the weather detection sub-system 106. Based on the landing information, pilots of the aircraft 102 may determine whether to attempt to land at the destination airport 206, or divert to the alternate airport 209, depending on a remaining amount of fuel. In at least one embodiment, the landing suggestion unit 109 outputs a landing suggestion signal indicative of a landing suggestion to at least one of the aircraft 102.

Figure 4:
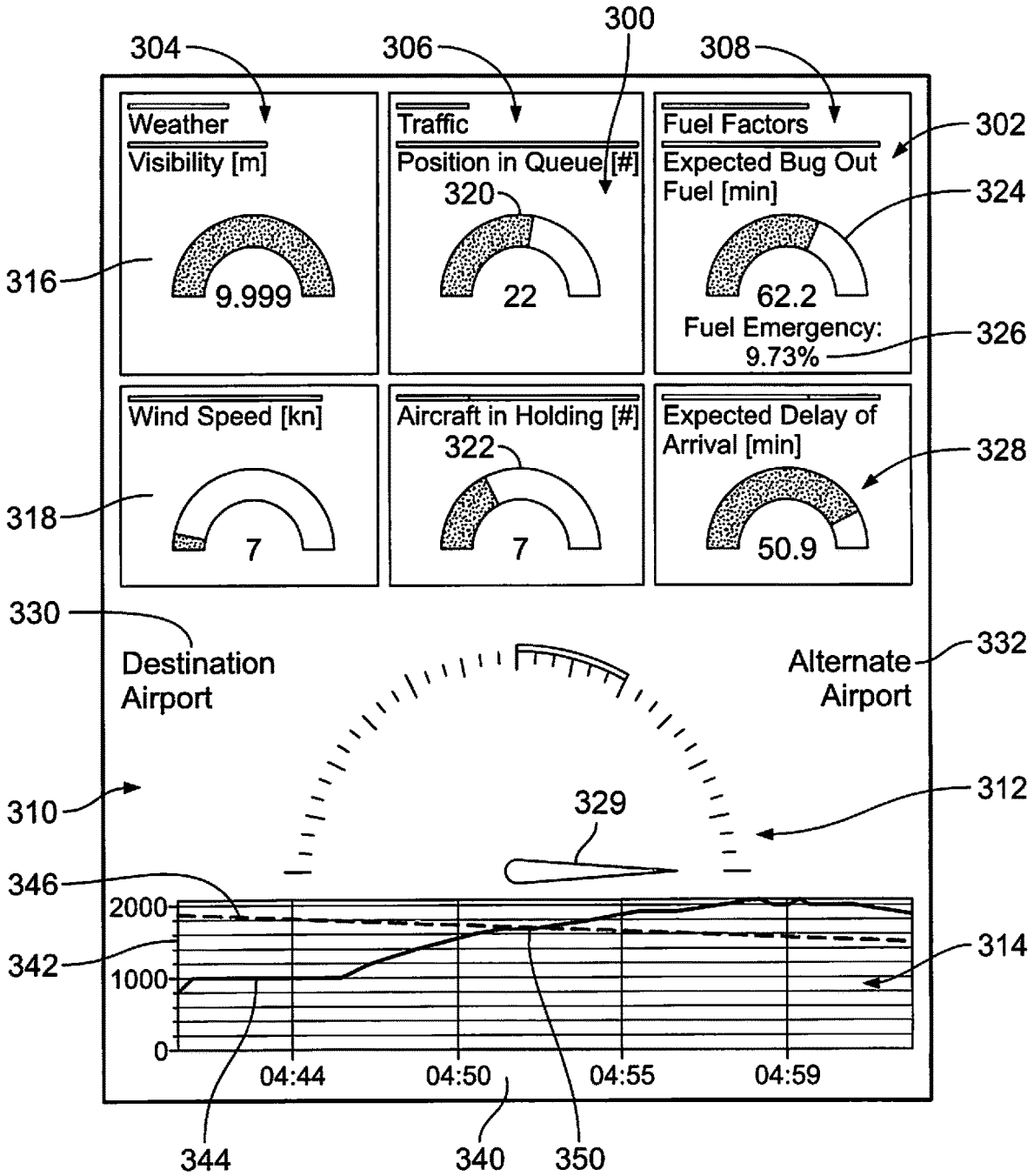
FIG. 4 is a diagrammatic representation of a front view of a user interface shown on a display, according to an exemplary embodiment of the present disclosure.

FIG. 4 is a diagrammatic representation of a front view of a user interface 300 shown on a display 302, according to an exemplary embodiment of the present disclosure. The display 302 may be a display within an aircraft, such as the display 116 shown in FIG. 2, at a monitoring center, an air traffic control tower, and/or the like.

The user interface 300 includes a weather section 304, a traffic section 306, and a fuel factors section 308. The user interface 300 may also include an airport comparison section 310, which may include a suggestion gauge 312 and/or a comparison graph 314.

Referring to FIGS. 2 and 4, the user interface 300 provides graphics indicative of the landing information, as determined by the arrival sequence determination unit 108, and a landing suggestion, as determined by the landing suggestion unit 109. The weather section 304 shows weather graphics indicative of current weather conditions at the destination airport and/or the alternate airport, as detected by the weather detection sub-system 106. For example, the weather section 304 may include a visibility graphic 316 (which may include a gauge, bar, dial, or the like) and a wind speed graphic 318 (which may include a gauge, bar, dial, or the like).

The visibility graphic 316 indicates a current visibility at the destination airport and/or the alternate airport. In at least one embodiment, an individual may switch between current visibility at the destination airport and the alternate airport through one or more keys, switches, touchscreen interfaces, and/or the like.

The wind speed graphic 318 indicates a current wind speed at the destination airport and/or the alternate airport. In at least one embodiment, an individual may switch between current wind speed at the destination airport and the alternate airport through one or more keys, switches, touchscreen interfaces, and/or the like.

The traffic section 306 shows traffic graphics indicative of a current position in a landing queue 320 and holding aircraft number 322 at the destination airport. The position in the landing queue is determined by the arrival sequence determination unit 108, as described above, while the number of aircraft in holding patterns may be determined by the tracking sub-system 104. The graphics may include gauges, bars, dials, or the like, and a user may selectively switch between the destination airport and the alternate airport.

The fuel factors section 308 includes a bug out fuel graphic 324 (which may include a gauge, bar, dial, or the like) and an expected arrival delay graphic 326 (which may include as a gauge, bar, dial, or the like). Bug out fuel is the amount of fuel necessary to divert to and land at the alternate airport. The bug out fuel graphic 324 visually indicates an amount of fuel left to allow the aircraft 102 to arrive at the alternate airport. The bug out fuel graphic 324 may also include an emergency probability index 326, which indicates a probability that bug out fuel will fall below a predetermined safe level. The expected arrival delay graphic 328 indicates the estimated amount of time until landing at the destination airport. Further, an individual may selectively switch any of the above graphics between the destination airport and the alternate airport through one or more keys, switches, touchscreen interfaces, and/or the like.

A pilot of the aircraft 102 may visually review the weather section 304, the traffic section 306, and the fuel factors section 308 of the user interface 300 to determine whether or not the aircraft 102 should wait to land at the destination airport or divert to the alternate airport. The user interface 300 provides a clear and concise visual display that allows an individual to quickly and easily determine whether there is a need to divert to the alternate airport.

As indicated, the user interface 300 may also include the airport comparison section 310, which may include the suggestion gauge 312 and/or the comparison graph 314. The suggestion gauge 312 may include a dial 329 that is configured to move between a destination airport suggestion indicia 330 and an alternate airport suggestion indicia 332 based on a landing suggestion. The suggestion gauge 312 provides a visual representation of the landing suggestion, as determined by the landing suggestion unit 109.

The comparison graph 314 includes a time axis 340 and a cost axis 342, as well as a destination airport projected cost use indication (such as a curve and/or line) 344 and an alternate airport projected cost use indication (such as a curve and/or line) 346 with respect to time. In at least one embodiment, a cost includes a cost of fuel and penalties arising from falling below a bug out fuel minimum. An intersection 350 of the cost use indication lines 344 and 346 indicates a time after which the aircraft 102 should be diverted to the alternate airport.

As shown, the user interface 300 may include one or both of the airport comparison section 310 and the comparison graph 314. The airport comparison section 310 and the comparison graph 314 are configured to graphically illustrate a landing decision comparison between the destination airport and the alternate airport.

The user interface 300 may include more or less graphics, text, numerical figures, and/or the like than shown. It is to be understood that the user interface 300 shown in FIG. 4 is one example of a display used to efficiently show information that allows an individual to make a landing decision in relation to the destination airport and the alternate airport.

Figure 5:
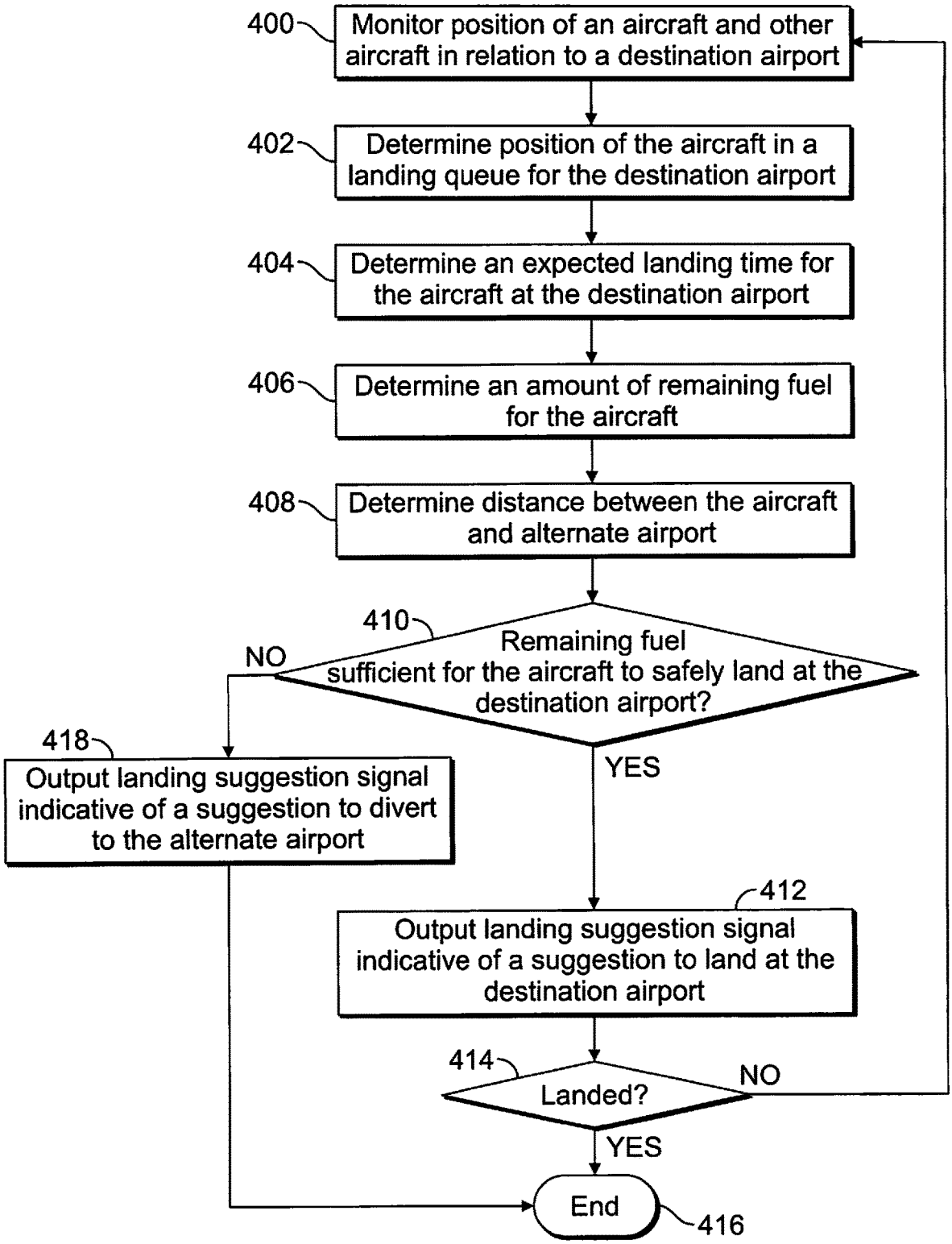
FIG. 5 illustrates a flow chart of an aircraft arrival determination method, according to an exemplary embodiment of the present disclosure.

FIG. 5 illustrates a flow chart of an aircraft arrival determination method, according to an exemplary embodiment of the present disclosure. Referring to FIGS. 1-5, the method begins at 400, at which the tracking sub-system 104 of the aircraft arrival determination system 100 monitors the position of an aircraft 102 and other aircraft 102 in relation to the destination airport 206. At 402, the arrival sequence determination unit 108 determines a position of the aircraft 102 (as well as the other aircraft 102) in a landing queue for the destination airport 206. At 404, the arrival sequence determination unit 108 determines an expected landing time for the aircraft 102 (as well as the other aircraft 102) at the destination airport 206, such as based on the position of the aircraft 102 in the landing queue, and weather delays (as detected by the weather detection sub-system 106).

At 406, an amount of remaining fuel in the aircraft is determined. For example, the aircraft 102 may output a fuel remaining signal to the aircraft arrival determination system 100. The landing suggestion unit 109 may analyze the remaining fuel signal. In at least one other embodiment, the landing suggestion unit 109 may determine an amount of remaining fuel for the aircraft 102 based on the amount of fuel at takeoff, the time of flight, the distance of the flight, and/or the like.

At 408, a distance between the aircraft 102 and an alternate airport 209 is determined. For example, the tracking sub-system 104 tracks a current position of the aircraft 102. The landing suggestion unit 109 may then monitor a distance between the tracked position of the aircraft 102 and the alternate airport 209.

At 410, the landing suggestion unit 109 assesses whether the remaining fuel for the aircraft 102 is sufficient for the aircraft to safely land at the destination airport 206. A safe level of fuel for landing may be defined by a predetermined amount or threshold of fuel (such as 25% full) at a time of landing. If, at 410, the landing suggestion unit 109 determines that the remaining fuel is sufficient for the aircraft 102 to safely land at the destination airport 206, the method proceeds from 410 to 412, at which the landing suggestion unit 109 outputs a landing suggestion signal indicative of a suggestion to land at the destination airport 206. At 414, the aircraft arrival determination system 100 determines whether the aircraft 102 has landed at the destination airport 206 (such as via the tracking sub-system 104). If the aircraft 102 has not landed, the method returns to 400. If, however, the aircraft 102 has landed, the method ends at 416.

If at 410, the landing suggestion unit 109 determines that the remaining fuel is insufficient for the aircraft 102 to safely land at the destination airport 206, the method proceeds from 410 to 418, at which the landing suggestion unit 109 outputs a landing suggestion signal indicative of a suggestion to divert to the alternate airport 209. The method may then end at 416.

Figure 6:
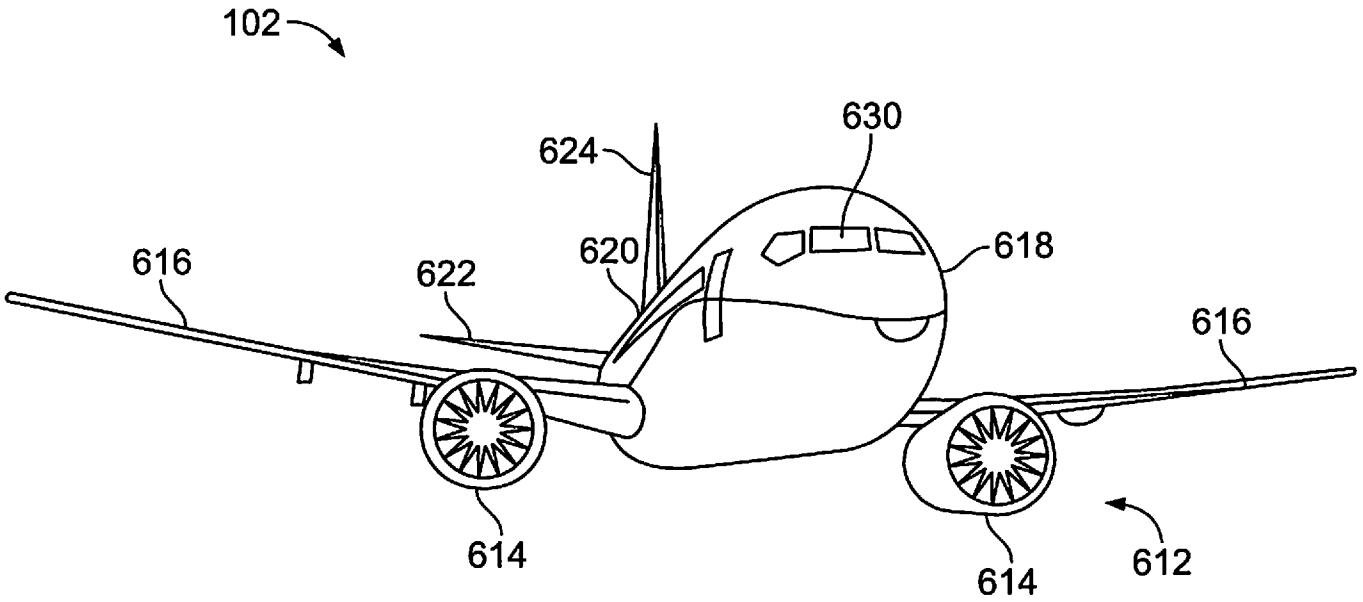
FIG. 6 is a diagrammatic representation of a front perspective view of an aircraft, according to an exemplary embodiment of the present disclosure.

FIG. 6 is a diagrammatic representation of a front perspective view of the aircraft 102, according to an exemplary embodiment of the present disclosure. The aircraft 102 includes a propulsion system 612 that may include two turbofan engines 614, for example. Optionally, the propulsion system 612 may include more engines 614 than shown. The engines 614 are carried by wings 616 of the aircraft 102. In other embodiments, the engines 614 may be carried by a fuselage 618 and/or an empennage 620. The empennage 620 may also support horizontal stabilizers 622 and a vertical stabilizer 624. The fuselage 618 of the aircraft 102 defines an internal cabin, which may include a cockpit 630, one or more work sections (for example, galleys, personnel carry-on baggage areas, and the like), one or more passenger sections (for example, first class, business class, and coach sections), and an aft section in which an aft rest area assembly may be positioned.

Referring to FIGS. 1-6, embodiments of the present disclosure provide systems and methods that allow large amounts of data to be quickly and efficiently analyzed by a computing device. For example, numerous aircraft may be proximate to a destination airport, each of which is scheduled to land. The scheduling process may be on an aircraft-by-aircraft basis, or on a batch basis, in which all aircraft within a particular range are scheduled. As such, large amounts of data are being tracked and analyzed. The vast amounts of data are efficiently organized and/or analyzed by the aircraft arrival determination system 100, as described above. The aircraft arrival determination system 100 analyzes the data in a relatively short time in order to quickly and efficiently output ordered positions in a landing queue, estimated landing times, and landing suggestions for the various aircraft within the vicinity of the destination airport. For example, the aircraft arrival determination system 100 analyzes current flight data and outputs the data for the various aircraft in real time. A human being would be incapable of efficiently analyzing such vast amounts of data in such a short time. As such, embodiments of the present disclosure provide increased and efficient functionality with respect to prior computing systems, and enormously superior performance in relation to a human being analyzing the vast amounts of data. In short, embodiments of the present disclosure provide systems and methods that analyze thousands, if not millions, of calculations and computations that a human being is incapable of efficiently, effectively and accurately managing.

As described herein, embodiments of the present disclosure provide systems and methods for accurately predicting arrival times for aircraft at a destination airport. Further, embodiments of the present disclosure provide systems and methods for allowing individuals (such as pilots, dispatchers, and air traffic controllers) to quickly and accurately assess whether or not to divert aircraft to an alternate airport due to an expected delay at an original destination airport.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. An aircraft arrival determination system comprising:

an arrival sequence determination unit that is configured to determine a position of an aircraft within a landing queue for a destination airport and an estimated landing time for the aircraft at the destination airport; and a user interface that is configured to show the position of the aircraft within the landing queue for the destination airport and the estimated landing time for the aircraft at the destination airport, wherein the user interface provides a visual display that facilitates a determination of whether there is a need to divert from the destination airport to an alternate airport, and wherein the user interface shows a bug out distance in relation to the destination airport, the bug out distance representing a decision threshold in which the determination is to be made.

2. The aircraft arrival determination system of claim 1, further comprising:

a landing suggestion unit that is configured to provide a landing suggestion for the aircraft, wherein the landing suggestion provides information related to landing at the destination airport or diverting from the destination airport to an alternate airport.

3. The aircraft arrival determination system of claim 2, wherein the landing suggestion unit is configured to provide the landing suggestion based on a first distance between the aircraft and the destination airport, a second distance between the aircraft and the alternate airport, and a remaining amount of fuel of the aircraft.

4. The aircraft arrival determination system of claim 1, further comprising a tracking sub-system that is configured to track a location of the aircraft in relation to the destination airport.

5. The aircraft arrival determination system of claim 4, wherein the tracking sub-system is an automatic depending surveillance-broadcast (ADS-B) tracking sub-system.

6. The aircraft arrival determination system of claim 1, further comprising a weather detection sub-system that is configured to detect weather conditions proximate to the destination airport.

7. The aircraft arrival determination system of claim 1, wherein the user interface further shows a bug out fuel graphic indicative of an amount of fuel left for the aircraft to land at the alternate airport, wherein the bug out fuel graphic also shows an emergency probability index indicative of a probability of the amount of fuel left for the aircraft to land at the alternate airport falling below a predetermined safe level.

8. The aircraft arrival determination system of claim 1, wherein the user interface is onboard the aircraft.

9. The aircraft arrival determination system of claim 1, wherein the user interface comprises:

a weather section that is configured to show weather graphics indicative of current weather conditions at one or both of the destination airport or the alternate airport;

a traffic section that is configured to show traffic graphics indicative of a current position of the aircraft within the landing queue for the destination airport; and a fuel factors section that is configured to show a bug out fuel graphic indicative of an amount of fuel left for the aircraft to land at the alternate airport.

10. The aircraft arrival determination system of claim 1, wherein the user interface comprises one or both of an airport comparison section or a comparison graph, wherein the airport comparison section and the comparison graph are configured to show a graphical representation of a landing decision comparison between the destination airport and the alternate airport.

11. An aircraft arrival determination method comprising:

determining, by an arrival sequence determination unit, a position of an aircraft within a landing queue for a destination airport and an estimated landing time for the aircraft at the destination airport; and showing, on a user interface, the position of the aircraft within the landing queue for the destination airport and the estimated landing time for the aircraft at the destination airport, wherein the user interface provides a visual display that allows an individual to determine whether there is a need to divert from the destination airport to an alternate airport, wherein the showing, on the user interface, comprises:

showing a bug out distance in relation to the destination airport, the bug out distance representing a decision threshold in which the determination is to be made.

12. The aircraft arrival determination method of claim 11, further comprising:

providing, by a landing suggestion unit, a landing suggestion for the aircraft, wherein the landing suggestion provides information related to landing at the destination airport or diverting from the destination airport to an alternate airport.

13. The aircraft arrival determination method of claim 12, wherein the providing comprises basing the landing suggestion unit on a first distance between the aircraft and the destination airport, a second distance between the aircraft and the alternate airport, and a remaining amount of fuel of the aircraft.

14. The aircraft arrival determination method of claim 11, further comprising tracking, by a tracking sub-system, a location of the aircraft in relation to the destination airport.

15. The aircraft arrival determination method of claim 11, further comprising detecting, by a weather detection sub-system, weather conditions proximate to the destination airport.

16. The aircraft arrival determination method of claim 11, wherein the showing, on the user interface, further comprises:

showing a bug out fuel graphic indicative of an amount of fuel left for the aircraft to land at the alternate airport; and showing, on the bug out fuel graphic, an emergency probability index indicative of a probability of the amount of fuel left for the aircraft to land at the alternate airport falling below a predetermined safe level.

17. The aircraft arrival determination method of claim 16, wherein the showing comprises:

showing, on a weather section, weather graphics indicative of current weather conditions at one or both of the destination airport or the alternate airport;

showing, on a traffic section, traffic graphics indicative of a current position of the aircraft within the landing queue for the destination airport; and showing, on a fuel factors section, the bug out fuel graphic indicative of the amount of fuel left for the aircraft to land at the alternate airport.

18. The aircraft arrival determination method of claim 16, wherein the showing, on the user interface, further comprises showing, on one or both of an airport comparison section or a comparison graph, a graphical representation of a landing decision comparison between the destination airport and the alternate airport.

19. An aircraft arrival determination system comprising:

an arrival sequence determination unit that is configured to determine a position of an aircraft within a landing queue for a destination airport and an estimated landing time for the aircraft at the destination airport; and a user interface that is configured to show the position of the aircraft within the landing queue for the destination airport and the estimated landing time for the aircraft at the destination airport, wherein the user interface shows a bug out fuel graphic indicative of an amount of fuel left for the aircraft to land at an alternate airport, and wherein the bug out fuel graphic also shows an emergency probability index indicative of a probability of the amount of fuel left for the aircraft to land at the alternate airport falling below a predetermined safe level.

20. An aircraft arrival determination method comprising:

determining, by an arrival sequence determination unit, a position of an aircraft within a landing queue for a destination airport and an estimated landing time for the aircraft at the destination airport; and showing, on a user interface, the position of the aircraft within the landing queue for the destination airport and the estimated landing time for the aircraft at the destination airport, wherein the user interface provides a visual display that allows an individual to determine whether there is a need to divert from the destination airport to an alternate airport, wherein the showing, on the user interface, comprises:

showing a bug out fuel graphic indicative of an amount of fuel left for the aircraft to land at the alternate airport; and showing, on the bug out fuel graphic, an emergency probability index indicative of a probability of the amount of fuel left for the aircraft to land at the alternate airport falling below a predetermined safe level.

* * * * *